US005830078A

United States Patent [19]

McMahan

[11] Patent Number: 5,830,078

[45] Date of Patent: Nov. 3, 1998

[54] GOLF CLUB HEAD

[76] Inventor: Clifton H. McMahan, 200 Bermuda Run Dr., Advance, N.C. 27006

[21] Appl. No.: 943,001

[22] Filed: Oct. 2, 1997

[51] Int. Cl.[6] ..... A63B 53/04

[52] U.S. Cl. ..... 473/252; 473/341; 473/349

[58] Field of Search ..... 473/324, 340, 473/341, 349, 313, 251, 252, 256, 219, 334, 335, 336, 337, 338, 339, 346, 291, 255

[56] References Cited

U.S. PATENT DOCUMENTS

| | | | |
|---|---|---|---|
| 3,064,975 | 11/1962 | Smith . | |
| 3,770,279 | 11/1973 | Phinny . | |
| 3,841,640 | 10/1974 | Gaulocher . | |
| 4,869,507 | 9/1989 | Sahm | 473/337 |
| 4,995,612 | 2/1991 | Finney . | |
| 5,127,653 | 7/1992 | Nelson . | |
| 5,344,151 | 9/1994 | Anderson | 473/337 |
| 5,456,464 | 10/1995 | Davenport . | |
| 5,464,218 | 11/1995 | Schmidt . | |
| 5,489,097 | 2/1996 | Simmons . | |
| 5,501,453 | 3/1996 | Hurst . | |
| 5,518,235 | 5/1996 | Mendenhall . | |
| 5,533,728 | 7/1996 | Pehoski . | |
| 5,544,883 | 8/1996 | Meyer . | |
| 5,580,058 | 12/1996 | Coughlin . | |
| 5,630,765 | 5/1997 | Moore . | |

*Primary Examiner*—Sebastiano Passaniti

*Attorney, Agent, or Firm*—John M. Harrington; Kilpatrick Stockton LLP

[57] ABSTRACT

A golf club head according to the present invention has an elongate, substantially planar club face with top and bottom edges, a heel end, and a toe end. The club head includes heel and toe portions which extend rearward from the club face between the top and bottom edges of the club face. A rear portion of the club head includes a cantilever portion having a rear member disposed thereon. The center of mass of the rear portion is disposed a distance rearward of the respective centers of mass of the heel and toe portions and rearward of the combined center of mass of the heel and toe portions. The club head is made of a light-weight yet durable material with a relatively low specific gravity. Front and rear sighting lines may also be included along the central axis of the club head at or near the top edge of the head or on the rear member.

20 Claims, 2 Drawing Sheets

GOLF CLUB HEAD

BACKGROUND OF THE INVENTION

1. Field of the Invention

The present invention relates in general to golf club heads, and in particular, to a golf club head suitable for use as the golf club head of a golf putter.

2. Description of the Prior Art

Various types of golf club heads which attempt to balance the weight of the golf club head between the heel and toe ends of the golf club head are known in the art and have been available for many years. Such prior art devices were sometimes referred to as "face-balanced" golf club heads, because the purported objective of such prior art devices was to have the center of mass of the golf club head disposed about mid-way between the heel and toe ends of the face portion of the golf club head.

Such face balancing of the golf club head at or near the center of the face of the golf club head was believed to minimize inaccurate putting of a golf ball by diminishing a tendency of the golf club head to rotate, thus rotating the face of the golf club head relative to the intended path of a golf ball (i.e., "opening" or "closing" the face of the golf club head) upon impact between the face of the golf club head and the golf ball.

SUMMARY OF THE INVENTION

The present invention is based on the discovery that an arrangement of the elements of the golf club head such that the center of mass of the golf club head is disposed substantially rearward of the face of the golf club head, rather than at or near the face of the golf club head, greatly reduces any tendency to rotate the golf club head during a putting stroke and thus greatly improves accuracy in putting a golf ball on the intended path. The present invention is based on the further discovery, that such arrangement also minimizes the tendency to rotate the golf club head either on the back stroke or on the forward stroke before impact between the face of the golf club head and the golf ball.

A golf club head according to the present invention has an elongate, substantially planar club face with top and bottom edges, a heel end, and a toe end. The golf club head includes a heel portion disposed at or near the heel end, which extends rearward from the club face between the top and bottom edges at or near the heel end of the club face. The golf club head also includes a toe portion, which extends rearward from the club face between the top and bottom edges of the club face at or near the toe end of the club face. Further, the golf club head includes a rear portion which comprises a cantilever that extends rearward of the club face and a rear member supported on the cantilever that is disposed rearward of and about equidistant from the heel and toe portions.

Each of the heel and toe portions has a center of mass that is disposed rearward of the club face, and the combined center of mass of the heel and toe portions lies about halfway between the centers of mass of each of the heel and toe portions on an imaginary plane substantially bisecting the club face along the approximate central axis of the golf club head. Further, the center of mass of the rear portion is disposed a distance rearward of the respective centers of mass of the heel and toe portions, and consequently rearward of the combined center of mass of the heel and toe portions, and lies on the same imaginary plane substantially bisecting the club face along the approximate central axis of the club head as the combined center of mass of the heel and toe portions. Accordingly, the combined center of mass of the heel and toe portions and the rear portion is disposed rearward of the combined center of mass of the heel and toe portions and substantially rearward of the club face and lies on the same imaginary plane substantially bisecting the club face along the approximate central axis of the club head as the combined center of mass of the heel and toe portions and the center of mass of the rear portion.

The golf club head also includes a bottom surface or sole which extends rearward from the lower edge of the club face and which is defined by the combined bottom surfaces of the heel, toe and rear portions of the golf club head. Preferably, each of the heel, toe and rear portions of the golf club head includes a weight component which may be formed substantially as a disc, although other shapes will tung. Each weight component is received in a correspondingly shaped recess formed in portions of the sole which correspond, respectively, to the bottom surfaces of the heel, toe and rear portions of the golf club head.

In the preferred embodiment, the bottom surface or sole of the golf club head comprises a pair of substantially planar halves, each of which extends rearward from the bottom edge of the club face on opposite sides of the central axis of the golf club head and which together define an angle between the halves along the central axis, so that the sole of the golf club head has a somewhat V-shaped surface. However, it will be appreciated that the bottom surface or sole of the golf club head may be made entirely flat. Preferably, the golf club head is made of a light-weight yet durable material with a relatively low specific gravity such as aluminum alloy, and the weight components are made of a heavier material having a higher specific gravity such as brass, lead, or tungsten, so that the combined weight of the golf club head and the weight components is not excessive.

Each of the heel and toe portions includes an enlarged portion with an inner wall and a leg portion having a rear wall. The respective enlarged portions are spaced apart from one another, and the respective leg portions are joined to one another. The cantilever is formed as a plate with an upper surface that intersects the respective inner and rear walls to partially define a cavity. The plate includes a substantially arcuate marginal edge with a distal edge portion which is spaced rearward of and equidistant from the respective enlarged portions, and the rear member is formed adjacent the distal edge portion.

The enlarged heel portion of the golf club head has a top surface in which an opening is formed to receive the bottom end of a golf club shaft. The opening is defined as a substantially cylindrically shaped hole with a central axis which preferably defines an angle of about 72 degrees up to about 90 degrees relative to the top edge of the club face. In the preferred embodiment, a front sighting line or groove extends rearward from at or near the top edge of the club face along the central axis of the golf club head, and a rear sighting line or groove is inscribed on the rear member which likewise extends along the central axis of the golf club head.

The foregoing focuses on the more important features of the invention in order that the detailed description which follows may be better understood and in order that the present contribution to the art may be better appreciated. There are, of course, additional features of the invention which will be described hereinafter and which will form the subject matter of the claims appended hereto. It is to be understood that the invention is not limited in its application to the details of construction and to the arrangement of the components set forth in the following description and drawings.

The invention is capable of other embodiments and of being practiced and of being carried out in various ways. It is to be further understood that the phraseology and terminology employed herein are for the purpose of description and are not to be considered as limiting. Those skilled in the art will appreciate that the conception on which this disclosure is based may readily be used as a basis for designing the structures, methods and systems for carrying out the several purposes of the present invention. The claims are regarded as including such equivalent constructions so long as they do not depart from the spirit and scope of the present invention.

From the foregoing summary, it is apparent that an object of the present invention is to provide a new and improved golf club head which has all of the advantages, and more, of prior art devices, and none of the disadvantages.

It is another object of the present invention is to provide a new and precision made golf club head with the effective center of mass of the golf club head disposed substantially rearward of the face of the golf club head, thereby greatly reducing a tendency to rotate the golf club head during a putting stroke, likewise greatly improving accuracy in putting a golf ball on the intended path.

Yet another object of the present invention to provide a new and improved golf club head that is more reliable and functional and easier and less costly to manufacture than those presently available.

These, together with other objects of the present invention, along with the various features of novelty which characterize the invention, are pointed out with particularity in the claims annexed to and forming a part of this document.

For a better understanding of the invention, its operating advantages, and the specific objects attained by its uses, reference should be made to the accompanying drawings in which like characters of reference designate like parts throughout the several views.

BRIEF DESCRIPTION OF THE DRAWINGS

This invention will be better understood and objects other than those set forth above will become apparent when consideration is given to the following detailed description. Such description makes reference to the annexed drawings wherein.

DETAILED DESCRIPTION OF THE DRAWINGS

Figure 1:
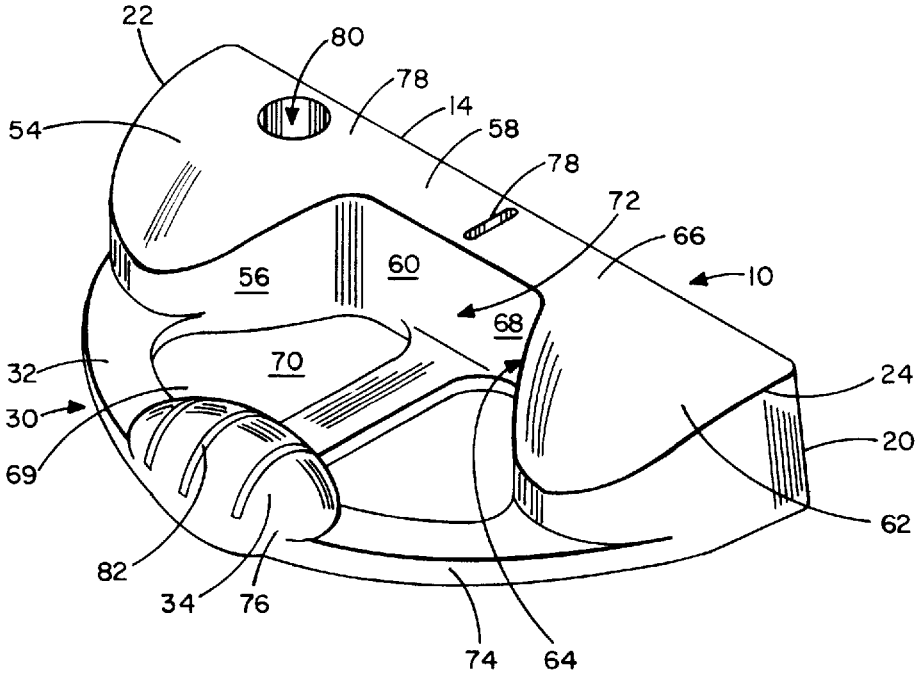
FIG. 1 is a perspective view of a golf club head in accordance with the present invention.
Figure 2:
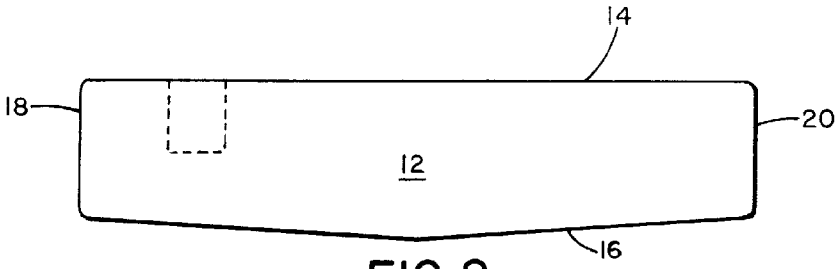
FIG. 2 is a front elevational view of the golf club head of FIG. 1.

A golf club head according to the present invention, which is suitable for use as the golf club head of a putter, is shown generally as 10 in FIG. 1. It will be appreciated that while the golf club head for a putter is disclosed herein, the present invention is applicable to golf clubs other than a putter. Golf club head 10 has an elongate, substantially planar club face 12 having top and bottom edges 14, 16, a heel end 18, and a toe end 20 as shown in FIG. 2. Golf club head 10 includes an enlarged heel portion 22 disposed at or near heel end 18. Heel portion 22 extends rearward from club face 12 between top and bottom edges 14, 16 at or near heel end 18 of club face 12. Golf club head 10 likewise includes an enlarged toe portion 24 which extends rearward from club face 12 between top and bottom edges 14, 16 at or near toe end 20 of club face 12. In the preferred embodiment, heel and toe portions 22, 24 extend rearward from club face 12 between top and bottom edges 14, 16, but it will be appreciated that portions of heel and toe portions 22, 24 may equally well extend above top edge 14 or below bottom edge 16. In any event, heel portion 22 is enlarged to provide a concentration of mass at or near heel end 18 of club face 12, and toe portion 24 is likewise enlarged to provide another concentration of mass at or near toe end 20 of club face 12. Heel portion 22 has a center of mass illustrated by point 26 disposed a distance rearward of club face 12 near heel end 18 of club face 12, and toe portion 24 has a center of mass illustrated by point 28 disposed a distance rearward of club face 12 near toe end 20 of club face 12. Thus, the combined center of mass of heel and toe portions 22, 24, illustrated by point 29, lies about half-way between respective centers of mass 26, 28 of heel and toe portions 22, 24 on an imaginary plane substantially perpendicular to and substantially bisecting club face 12 along central axis X-X' of golf club head 10.

Figure 3:
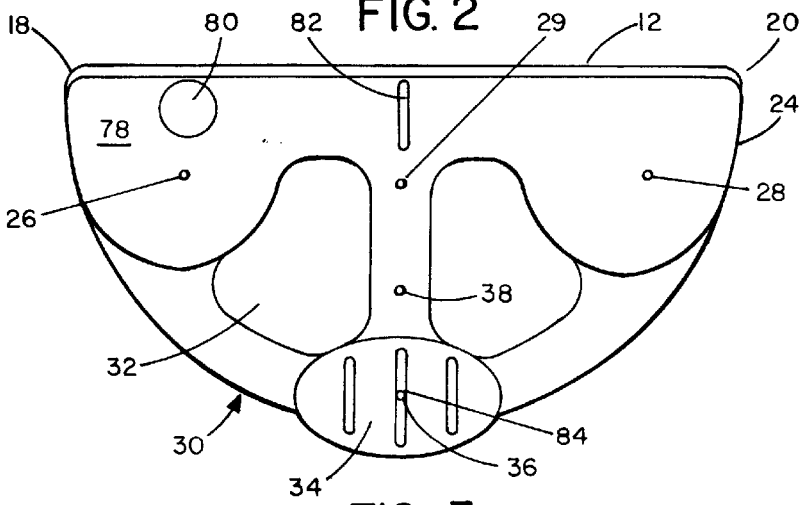
FIG. 3 is a top plan view of the golf club head of FIG. 1.
Figure 4:
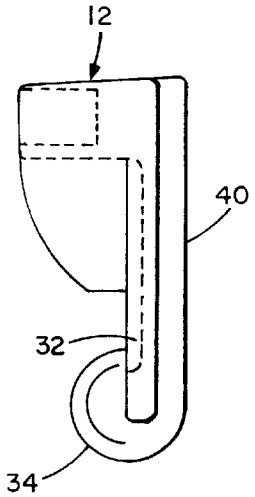
FIG. 4 is a right side elevational view of the golf club head of FIG. 1.

Golf club head 10 also has a rear portion, shown generally as 30 in FIGS. 1 and 3, which includes a cantilever 32 extending rearward of club face 12 and a rear member 34 supported on cantilever 32 rearward of and about equidistant from heel and toe portions 22, 24. In the preferred embodiment, cantilever 32 is configured as a ledge extending rearward from the vicinity of lower edge 16 of club face 12, and rear member 34 has a somewhat oval shape. However, cantilever 32 can take the form of any projecting structure extending rearward of club face 12 to support rear member 34 rearward of club face 12 and rearward of enlarged heel and toe portions 22, 24. Rear member 34 is enlarged to provide a concentration of mass rearward of club face 12 and rearward of heel and toe portions 22, 24, and rear portion 30 has a center of mass, illustrated by point 36, disposed a distance rearward of club face 12 and rearward of the respective centers of mass 26, 28 of heel and toe portions 22, 24. Consequently, center of mass 36 of rear portion 30 is disposed rearward of combined center of mass 29 of heel and toe portions 22, 24 and lies on the same imaginary plane substantially perpendicular to and substantially bisecting club face 12 along central axis X-X' of club head 10 as combined center of mass 29 of heel and toe portions 22, 24. Accordingly, the combined center of mass of heel, toe and rear portions 22, 24, 30, illustrated by point 38, is disposed a distance rearward of combined center of mass 29 of heel and toe portions 22, 24 and a substantial distance rearward of club face 12 and lies on the same imaginary plane substantially perpendicular to and substantially bisecting club face 12 along central axis X-X' of club head 10 as the combined center of mass 29 of heel and toe portions 22, 24 and the center of mass 36 of rear portion 30.

Figure 5:
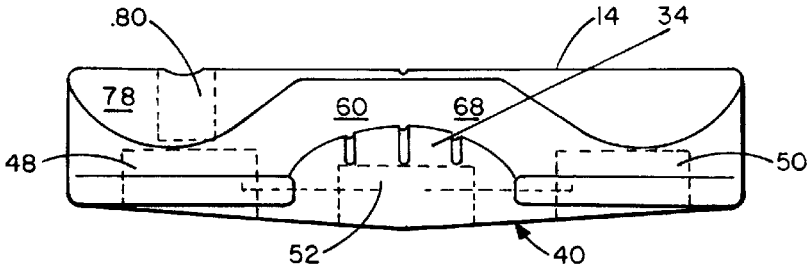
FIG. 5 is a rear elevational view of the golf club head of FIG. 1.
Figure 6:
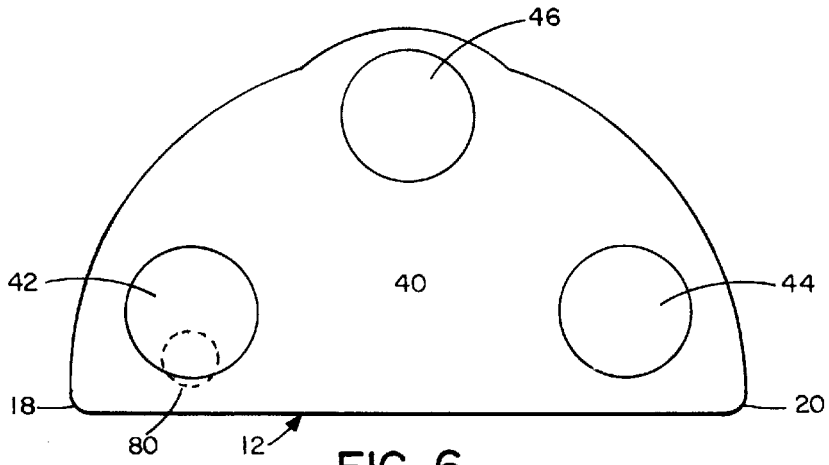
FIG. 6 is a bottom plan view of the golf club head of FIG. 1.

Each of heel, toe and rear portions 22, 24, 30 has a bottom surface, and the bottom surfaces of heel, toe and rear portions 22, 24, 30 together form a bottom surface or sole 40 of golf club 10 extending rearward from lower edge 16 of club face 12 as shown in FIG. 6 In order to provide a still greater concentration of mass rearward of club face 12 and rearward of heel and toe portions 22, 24, heel portion 30, and preferably each of heel, toe and rear portions 22, 24, 30, includes a weight component 42, 44, 46, respectively, as shown in FIG. 6. Alternatively, only one or only two of heel, toe and rear portions 22, 24, 30 may be provided with a weight component 42, 44, 46, so long as the combined center of mass 38 of heel and toe and rear portions 22, 24, 30 is disposed a substantial distance rearward of club face 12 and preferably lying on a plane substantially perpendicular to and substantially bisecting club face 12 along central axis X-X' of club head 10. While it will be appreciated by those skilled in the art that weight components 42, 44, 46 may be produced in any number and variety of shapes, in the preferred embodiment, each of weight components 42, 44, 46 is formed substantially as a disc with a diameter that is greater than its thickness. Weight components 42, 44, 46 are each received in a correspondingly shaped recess 48, 50, 52, as shown in FIG. 5, formed in portions of sole 40 corresponding, respectively, to the bottom surfaces of heel, toe and rear portions 22, 24, 30.

In the preferred embodiment, sole 40 is slightly convex with a pair of substantially planar halves extending rearward of bottom edge 16 of club face 12 on opposite sides of central axis X-X' of golf club head 10 at a slight angle relative to one another. However, it will be appreciated that sole 40 could be made entirely substantially flat or slightly arcuate. Further, in the preferred embodiment, club face 12 defines a loft angle "A" that is slightly less than 90 degrees, or about 87 degrees, relative to sole 40. It will likewise be appreciated that club face 12 could be disposed to define a loft angle from about 87 degrees up to about 90 degrees relative to sole 40.

It is to be understood that golf club head 10 and weight components 42, 44, 46 may be fabricated from any number of suitable materials. In order to minimize the total weight of golf club head 10, preferably golf club head 10 is made of a light weight yet durable material having a relatively low specific gravity such as aluminum alloy. At the same time, in order to further maximize concentrations of mass associated with enlarged heel and toe portions 22, 24 and enlarged rear member 34, weight components 42, 44, 46 are made of a heavier material having a higher specific gravity than golf club head 10, such as brass, lead or tungsten. Referring to FIG. 1, enlarged heel portion 22 includes an inner wall 56 and a leg portion 58 having a rear wall 60 which intersects inner wall 56. Enlarged toe portion 24 likewise includes an inner wall 64 and a leg portion 66 having a rear wall 68 which intersects inner wall 64. The inner walls 56, 64 of heel and toe portions 22, 24 are spaced opposite one another, and the leg portions 58, 66 are joined to one another such that rear walls 60, 68 form a continuous wall spaced rearward of and somewhat parallel to club face 12. The continuous wall formed by rear walls 60, 68 intersect each of inner walls 56, 64 to partially define a recess or cavity 72 between enlarged heel and toe portions 22, 24, and forward of enlarged rear member 34. Preferably, cantilever 32 is formed as a ledge or plate 69 with an upper surface 70 which intersects the continuous wall formed by rear walls 60, 68 and which likewise intersects inner walls 56, 64 to further define cavity 72. Preferably, ledge or plate 68 includes a substantially arcuate marginal edge 74 with a distal edge portion 76 which is spaced rearward of and substantially equidistant from enlarged portions heel and toe portions 22, 24 and on which enlarged member 34 is formed. The omission of mass in cavity 72 disposed between enlarged heel and toe portions 22, 24 and enlarged rear member 34 serves to further maximize concentrations of mass at or near heel and toe ends 18, 20 and at rear member 34, such that the combined center of mass 38 of heel, toe and rear portions 22, 24, 30 is disposed a substantial distance rearward of club face 12.

Referring to FIG. 1, enlarged heel portion 22 has a top surface 78 in which an opening 80 is formed to receive the bottom end of a golf club shaft (not shown). Opening 80 is defined as a substantially cylindrically shaped hole with a central axis which preferably defines an angle "A", as shown in FIG. 5, of from about 72 degrees up to about 90 degrees relative to top edge 14 of club face 12. Further, in the preferred embodiment, a front sighting line or groove 82 extends rearward from at or near top edge 14 of club face 12 along central axis X-X' of golf club head 10, and a second sight line or groove 84 is inscribed on rear member 34, likewise extending along central axis X-X' of golf club head 10.

With respect to the descriptions set forth above, optimum dimensional relationships of parts of the invention (to include variations in size, materials, shape, form, function and manner of operation, assembly and use) are deemed readily apparent and obvious to those skilled in the art, and all equivalent relationships to those illustrated in the drawings and described in the specification are intended to be encompassed herein. The foregoing is considered as illustrative only of the principal of the invention. Since numerous modifications and changes will readily occur to those skilled in the art, it is not intended to limit the invention to the exact construction and operation shown and described, and all suitable modifications and equivalents falling within the scope of the appended claims are deemed within the present inventive concept.

What is claimed is:

1. A golf club head comprising:

a club face with top and bottom edges and heel and toe ends;

an enlarged heel portion extending rearward from the club face proximate the heel end and having a center of mass;

an enlarged toe portion extending rearward from the club face proximate the toe end and likewise having a center of mass;

a rear portion including a cantilever extending rearward of the club face and an enlarged rear member supported on the cantilever rearward of the toe and heel portions, and the rear portion also having a center of mass; and the heel, toe and rear portions having a combined center of mass disposed rearward of the club face and rearward of the respective centers of mass of the heel and toe portions.

2. The golf club head of claim 1, wherein said combined center of mass of the heel, toe and rear portions lies rearward of the club face on a plane substantially perpendicular to and substantially bisecting the club face between said heel and toe ends.

3. The golf club head of claim 2, wherein said heel and toe portions have a combined center of mass disposed substantially half-way between said centers of mass of the heel and toe portions and lying on said plane substantially perpendicular to and substantially bisecting the club face between the heel and toe ends.

4. The golf club head of claim 3, wherein at least one of the heel, toe and rear portions includes a weight component.

5. The golf club head of claim 4, wherein said at least one of the heel, toe and rear portions includes a recess, and said weight component is received in said recess.

6. The golf club head of claim 5, wherein at least two of the heel, toe and rear portions include a weight component.

7. The golf club head of claim 6, wherein each of said at least two of the heel, toe and rear portions includes a recess, and said weight components are received in said recesses.

8. The golf club head of claim 7, wherein each of the heel, toe and rear portions includes a weight component and a recess, and said weight components are received in said recesses.

9. The golf club head of claim 8, wherein each of said heel, toe and rear portions includes a bottom surface, and said recesses are formed in said bottom surfaces.

10. The golf club head of claim 9, wherein said heel, toe and rear portions are made of a material having a predetermined specific gravity, and said weight components are made of a material having a specific gravity which is greater than said predetermined specific gravity.

11. The golf club head of claim 10, wherein said bottom surfaces of the heel, toe and rear portions define a sole extending rearward from the bottom edge of the club face and said recesses are formed in the sole.

12. The golf club head of claim 11, wherein each of said enlarged heel and toe portions includes an inner wall and a leg portion having a rear wall, the inner walls of the enlarged portions are spaced opposite one another, and the leg portions are joined to one another.

13. The golf club head of claim 12, wherein the cantilever is formed as a plate with an upper surface which intersects said inner and rear walls to define a cavity.

14. The golf club head of claim 13, wherein said plate has a marginal edge with a distal edge portion disposed substantially equidistant from said enlarged heel and toe portions and on which said enlarged rear member is formed.

15. The golf club head of claim 14, wherein said marginal edge is substantially arcuate.

16. The golf club head of claim 15, wherein said enlarged heel portion has a top surface with portions defining an opening adapted to receive an end of a shaft of the golf club.

17. The golf club head of claim 16, wherein said opening has a central axis which defines an angle of at least 72 degrees relative to the top edge of the club face.

18. The golf club head of claim 17, wherein said central axis defines an angle of up to 90 degrees relative to the top edge of the club face.

19. The golf club head of claim 18, wherein said heel, toe and rear portions are made of aluminum alloy and said weight components are made of brass, lead or tungsten.

20. The golf club head of claim 19, further comprising at least one sighting line extending rearward of said top edge of the club face.

* * * * *